US005568927A

United States Patent [19]

Badorrek

[11] Patent Number: 5,568,927

[45] Date of Patent: Oct. 29, 1996

[54] THREE-DIMENSIONAL MOVING TARGET SYSTEM

[76] Inventor: Hal C. Badorrek, 801 S. Carlisle La., Altoona, Pa. 16602

[21] Appl. No.: 378,783

[22] Filed: Jan. 26, 1995

[51] Int. Cl.[6] ..... F41J 3/00

[52] U.S. Cl. ..... 273/366; 119/839

[58] Field of Search ..... 273/366, 367, 273/368, 369, 370, 371, 403, 404, 407, 408; 119/839; 434/247

[56] References Cited

U.S. PATENT DOCUMENTS

| | | | |
|---|---|---|---|
| 2,819,900 | 1/1955 | Brackett | 273/366 |
| 3,128,096 | 4/1964 | Hammond et al. | 273/367 |
| 3,865,373 | 2/1975 | Knight . | |
| 4,076,247 | 2/1978 | Kim et al. . | |
| 4,081,056 | 3/1978 | Siitonen . | |
| 4,345,765 | 8/1982 | Wang . | |
| 5,325,817 | 7/1994 | Huffman | 119/839 |

FOREIGN PATENT DOCUMENTS

| | | | |
|---|---|---|---|
| 21651 | 10/1903 | United Kingdom | 273/366 |
| 20212 | 4/1911 | United Kingdom | 273/366 |

*Primary Examiner*—Mark S. Graham
*Attorney, Agent, or Firm*—Michael I. Kroll

[57] ABSTRACT

A three-dimensional moving target system comprising a track assembly and a three-dimensional target. A structure is for supporting the target in an upright position from the track assembly. A facility is for propelling the supporting structure with the target along the track assembly. An archer can practice at shooting an arrow from a bow at the target traveling along the track assembly.

12 Claims, 2 Drawing Sheets

THREE-DIMENSIONAL MOVING TARGET SYSTEM

BACKGROUND OF THE INVENTION

1. Field of the Invention

The instant invention relates generally to moving targets and more specifically it relates to a three-dimensional moving target system.

2. Description of the Prior Art

Numerous moving targets have been provided in prior art. For example, U.S. Pat. Nos. 3,865,373 to Knight; 4,076,247 to Kim et al.; 4,081,056 to Siitonen and 4,345,765 to Wang all are illustrative of such prior art. While these units may be suitable for the particular purpose to which they address, they would not be as suitable for the purposes of the present invention as heretofore described.

KNIGHT, LINDSAY CHARLES

MOVING TARGET TROLLEY, MOVING TARGET, AND TARGET RANGE

U.S. Pat. No. 3,865,373

There is disclosed a target range and mechanisms for use on those target ranges. The mechanisms comprise a trolley for use in shooting ranges. The trolley is constructed and arranged to be movable backwards and forwards along a track. A target moving mechanism is adapted, in use, to carry a target and to move the target from an operative shooting position to an inoperative shooting position. The target moving mechanism is adapted to move the target such that in use, the width of the trolley and target across the direction of intended movement of the trolley when the target is in the operative shooting position is not substantially greater than the width of the trolley and target across the direction of intended movement of the trolley when the target is in the operative shooting position. Preferably, the trolley has a target moving mechanism such that in use, the plane of the target extends parallel with the direction of intended movement of the trolley in both the operative and inoperative shooting positions. Preferably, the roller also has a target moving mechanism which is such as, in use, to move the target from the operative to inoperative shooting positions with the plane of the target swinging in a generally vertical plane extending in the direction of intended movement of the trolley. Alternatively, the trolley has a target moving mechanism which is such that, in use, the plane of the target extends transverse to the direction of intended movement of the trolley in both the operative and inoperative shooting positions. The range has a trolley and a track along which the trolley is to move. The track is of a width only sufficiently wide, to allow the trolley to pass and is of a depth which when the trolley is in the track the top of the trolley will be below the depth of the track. The path further being such that, in use, the trolley and the target, when in the inoperative position, are out of sight of a shooter at a firing position. The path over substantially its whole extent is also out of sight of the shooter at the firing position.

KIM, RAYMOND W. H.

FIGGE, ERWIN E.

MOVING TARGET ASSEMBLY AND CONTROL

U.S. Pat. No. 4,076,247

The disclosure relates to a moving target assembly for use in a target practice range. The moving target assembly includes a target, a target travel guide for guiding the target movement and a pair of straight sections, which are substantially at right angles to one another. A chain drive runs substantially parallel to the straight sections.

SIITONEN, ANSSI PEKKA

DRIVE MEANS FOR MOVING A TARGET FIGURE INTENDED FOR SPORTS SHOOTING

U.S. Pat. No. 4,081,056

The present invention concerns a drive mechanism for moving a target figure for use in sports shooting, comprising a frame, a pulley and a power wheel mounted on support of the frame. A power shaft is connected with the power wheel. An endless pulling rope, passes around the pulley and the power wheel, whereto the figure has been affixed. A moving weight is connected with the power shaft by the aid of a weight rope. The components are so arrange that the moving weight may be suspended to be borne by the weight rope wound around the power shaft. The gravity effect acting on the moving weight tends to move the figure by mediation of the weight rope, the power shaft, the power wheel and of the pulling rope. In accordance with the invention, the power shaft further comprises a holding member for winding the weight rope around the power shaft in one direction of winding and, by changing direction by support gained from the holding member, in the opposite direction of winding. The moving weight suspended from the weight rope will move the target figure first in one direction, while the weight rope is unwound from the power shaft up to the holding member, and in the opposite direction while the rope is unwound from the power shaft after the holding member in the opposite direction.

WANG, AUSTIN

MOVING TARGET MEANS OF SHOOTING GALLERY

U.S. Pat. No. 4,345,765

The present invention relates to a mechanism for providing air-supported floating light balls as moving targets in shooting galleries. The height of the light balls is constantly changed by varying the current passing through associated air pumps that produce air jets for lifting the light balls in the air. By changing the resistance of the current path by means of a rotating reheostat disc, will provide the light balls with an unpredictable and capricious nature.

SUMMARY OF THE INVENTION

A primary object of the present invention is to provide a three-dimensional moving target system that will overcome the shortcomings of the prior art devices.

Another object is to provide a three-dimensional moving target system that will allow an archer a realistic practice at shooting an arrow from a bow at a moving target traveling along a track, compared to shooting at a stationary target.

An additional object is to provide a three-dimensional moving target system in which different angles of shots will give the archer the practice needed for the actual live animal hunting event.

A further object is to provide a three-dimensional moving target system that is simple and easy to use.

A still further object is to provide a three-dimensional moving target system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
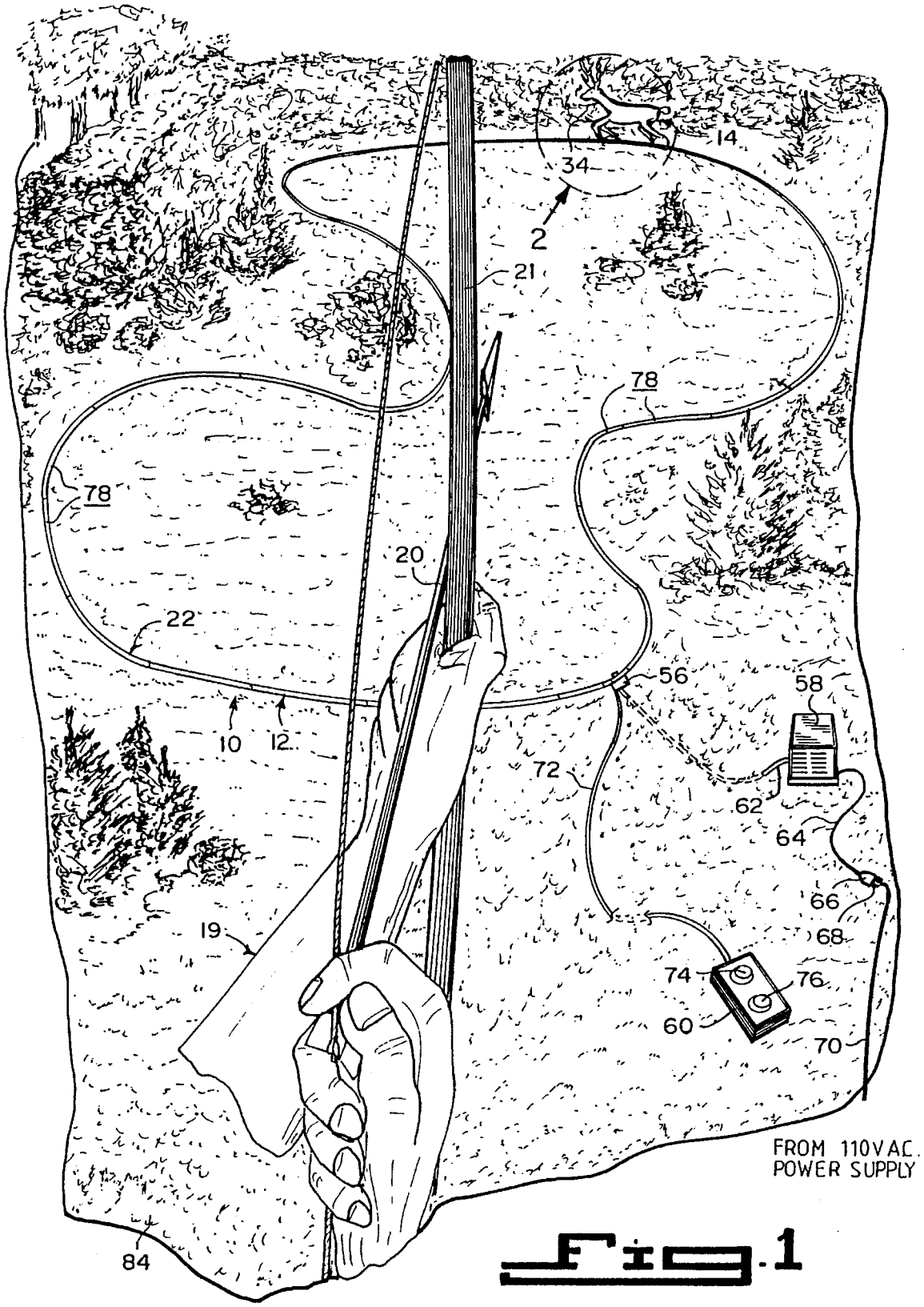
FIG. 1 is a perspective view of the instant invention, showing a portion of an archer shooting an arrow from a bow at a moving target in a track assembly of the instant invention.
Figures 2, 3, 4, 5, 6:
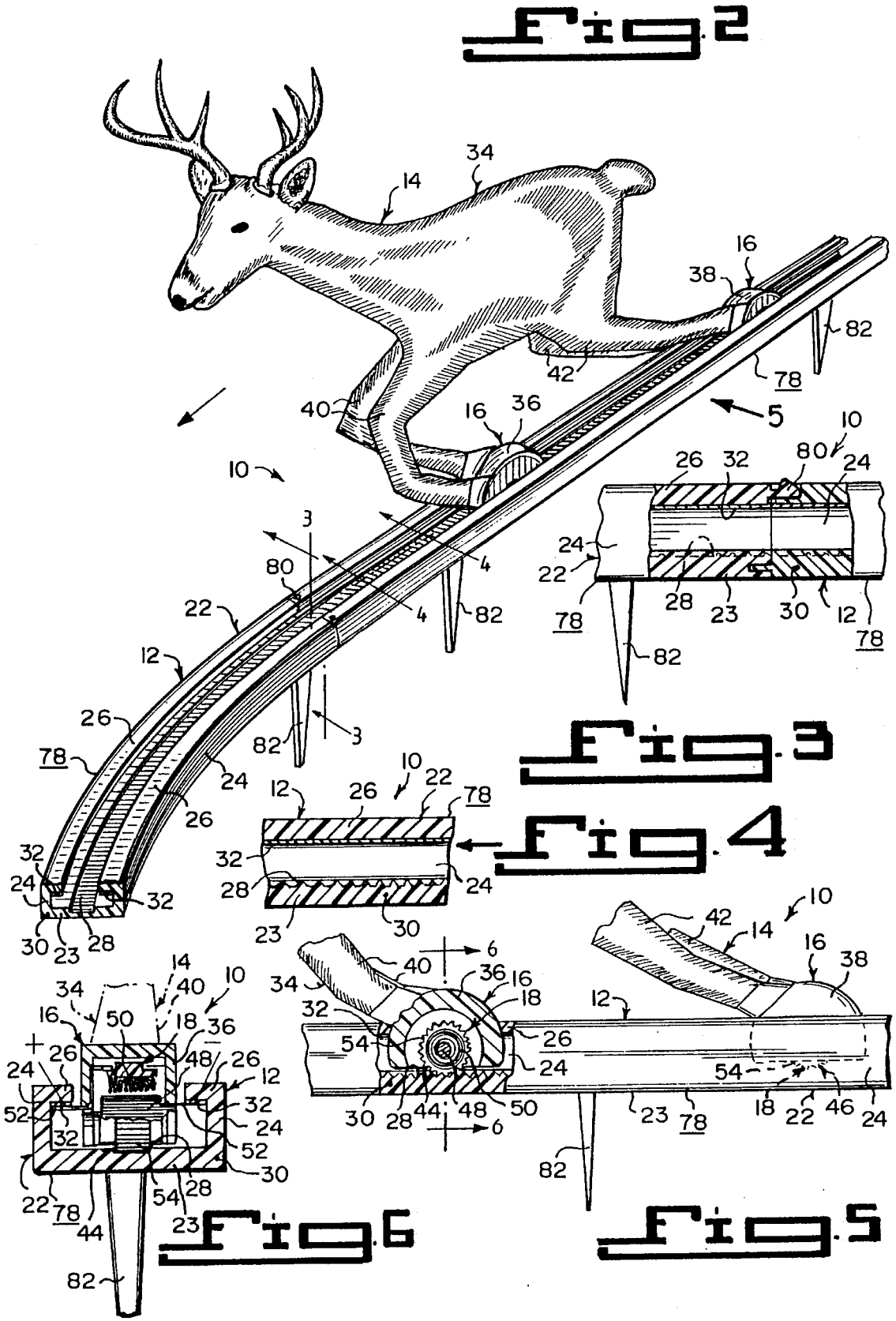
FIG. 2 is an enlarged perspective view of a portion of the instant invention as indicated by arrow 2 in FIG. 1.
FIG. 3 is a partial cross sectional view taken along line 3—3 in FIG. 2.
FIG. 4 is a cross sectional view taken along line 4—4 in FIG. 2.
FIG. 5 is an elevational view with parts broken away and in section taken in the direction of arrow 5 in FIG. 2.
FIG. 6 is a cross sectional view taken along line 6—6 in FIG. 5.

Turning now descriptively to the drawings, in which similar reference characters denote similar elements throughout the several views, FIGS. 1 through 6 illustrate a three-dimensional moving target system 10, comprising a track assembly 12 and a three-dimensional target 14. A structure 16 is for supporting the target 14 in an upright position from the track assembly 12. A facility 18 is for propelling the supporting structure 16 with the target 14 along the track assembly 12. An archer 19 can practice at shooting an arrow 20 from a bow 21 at the target 14 traveling along the track assembly 12.

The track assembly 12 is a continuous serpentine rail 22, having a bottom wall 23 and a pair of upstanding side walls 24. The rail 22 further includes a pair of flanges 26, with each flange 26 facing inwardly over the bottom wall 23 from a top edge of one side wall 24. The bottom wall 23 has a serrated course 28 therealong.

The rail 22 is fabricated out of a strong non-conductive plastic material 30. The rail 22 further contains a pair of metal conductor strips 32. Each conductor strip 32 is affixed to the underside of one flange 26.

The three-dimensional target 14 is in the shape of a simulated animal 34, such as a realistic deer and the like. The supporting structure 16 consists of a pair of semicircular non-conductive plastic housings 36, 38. The first housing 36 is connected to the front legs 40 of the simulated animal 34. The second housing 38 is connected to the rear legs 42 of the simulated animal 34. The first and second housing 36, 38 can fit into and ride along the rail 22.

The propelling facility 18 contains a pair of electric motors 44, 46. The first motor 44 is mounted within the first housing 36. The second motor 46 is mounted within the second housing 38.

Each motor 44, 46 includes a stator 48 with an armature 50 about the stator 48. A pair of current pickup arms 52 extend to the conductor strips 32 from the stator 48. A serrated drive wheel 54 is operated by the armature 50. The serrated drive wheel 54 engages with the serrated course 28 on the bottom wall 23 of the rail 22, to drive the simulated animal 34 forward.

As shown in FIG. 1, a connector 56 is electrically connected to the conductor strips 32 in the rail 22. A transformer 58 is electrically connected between a 110 VAC power supply and the connector 56. A control box 60 is electrically connected to the connector 56.

The transformer 58 contains a first electric cord 62 to the connector 56. A second electric cord 64 is also provided. An electric plug 66 is on a distal end of the second electric cord 64, so as to engage with an electric socket 68 on an extension cord 70 from the 110 VAC power supply.

The control box 60 includes an electric cord 72 to the connector 56. An on/off switch 74 turns the 110 VAC power supply on and off to the conductor strips 32. A speed regulator switch 76 operates the pair of electric motors 44, 46, to make the simulated animal 34 travel faster and slower along the rail 22.

The rail 22 is divided into a plurality of sections 78 with snap fasteners 80 between the sections 78, for holding the sections 78 together. Each section 78 of the rail 22 can include at least one spike 82 extending downwardly from the bottom wall 23. The spikes 82 can be inserted into the ground 84, to maintain the sections 78 of the rail 22 in a stationary position with respect to the ground 84.

Various modifications and changes to the three-dimensional moving target system 10 are as follows:

1. Adapt the track assembly 12 to interior use by installing cross ties under the bottom wall 23 of the rail 22.
2. The target system 10 can also be used for rifles, shotguns, pistols, muzzle loaders and other firearms.
3. If desired, use a wireless remote control.
4. The track assembly 12 can be of different configuration shapes.
5. Install speed bumps along the track assembly 12, to give more action while the simulated animal 34 is moving along the track assembly 12.
6. The simulated animal 34 can be electrically controlled to move various body parts, while traveling along the track assembly 12.
7. Have the rail 22 switch over to another rail 22 in an adjoining track assembly 12.
8. Make the track assembly 12 bi-directional, for the three-dimensional target 14 to move on.
9. Place two or more three-dimensional targets 14 on the track assembly 12 at the same time.
10. Place the spikes 82 into receptacles within the ground 84.
11. A plurality of track assemblies 12, are either connected together or are side by side.

12. The power source to the track assembly may be other than stated above.

13. The bottom wall 23 of the rail 22 may have weep holes, to allow water to drain off.

LIST OF REFERENCE NUMBERS

10 three-dimensional moving target system
12 track assembly
14 three-dimensional target
16 supporting structure for 14
18 propelling facility for 14
19 archer
20 arrow
21 box
22 continuous serpentine rail of 12
23 bottom wall of 22
24 upstanding side wall of 22
26 flange of 22
28 serrated course on 23
30 strong non-conductive plastic material of 22
32 metal conductor strip on 26
34 simulated animal for 14
36 first semicircular non-conductive plastic housing of 16
38 second semicircular non-conductive plastic housing of 16
40 front legs of 34 connected to 36
42 rear legs of 34 connected to 38
44 first electric motor of 18 in 36
46 second electric motor of 18 in 38
48 stator in 44 and 46
50 armature about 48
52 current pickup arm
54 serrated drive wheel
56 connector
58 transformer
60 control box
62 first electric cord of 58
64 second electric cord of 58
66 electric plug on 64
68 electric socket on 70
70 extension cord
72 electric cord of 60
74 on/off switch on 60
76 speed control switch on 60
78 section of 22
80 snap fastener
82 spike on 23
84 ground It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A three-dimensional moving target system comprising:

a) a track assembly, said track assembly including a continuous serpentine rail having a bottom wall and a pair of upstanding side walls, said rail further including a pair of flanges with each said flange facing inwardly over said bottom wall from a top edge of one said side wall, and said bottom wall having a serrated course therealong;

b) a three-dimensional target;

c) means for supporting said target in an upright position from said track assembly; and d) means for propelling said supporting means with said target along said track assembly, so that an archer can practice at shooting an arrow from a bow at said target travelling along said track assembly.

2. A three-dimensional moving target system as recited in claim 1, wherein said rail is fabricated out of a strong non-conductive plastic material.

3. A three-dimensional moving target system as recited in claim 2, wherein said rail further includes a pair of metal conductor strips, with each said conductor strip affixed to an underside of one said flange.

4. A three-dimensional moving target system as recited in claim 3, wherein said three-dimensional target is in the shape of a simulated animal, such as a realistic deer.

5. A three-dimensional moving target system as recited in claim 4, wherein said supporting means includes a pair of semicircular non-conductive plastic housings, with said first housing connected to front legs of said simulated animal and said second housing connected to rear legs of said simulated animal, whereby said first and second housings can fit into and ride along said rail.

6. A three-dimensional moving target system, as recited in claim 5, wherein said propelling means includes a pair of electric motors, with said first motor mounted within said first housing and said second motor mounted within said second housing.

7. A three-dimensional moving target system as recited in claim 6, wherein each said motor includes:

a) a stator;

b) an armature about said stator;

c) a pair of current pickup arms extending to said conductor strips from said stator; and d) a serrated drive wheel operated by said armature, whereby said serrated drive wheel engages with said serrated course on said bottom wall of said rail, to drive said simulated animal forward.

8. A three-dimensional moving target system as recited in claim 7, further including:

a) a connector electrically connected to said conductor strips in said rail;

b) a transformer electrically connected between a 110 VAC power supply and said connector; and c) a control box electrically connected to said connector.

9. A three-dimensional moving target system as recited in claim 8, wherein said transformer includes:

a) a first electric cord to said connector;

b) a second electric cord; and c) an electric plug on a distal end of said second electric cord, so as to engage with an electric socket on an extension cord from the 110 VAC power supply.

10. A three-dimensional moving target system as recited in claim 9, wherein said control box includes:

a) an electric cord to said connector;

b) an on/off switch to turn the 110 VAC power supply on and off to said conductor strips; and c) a speed regulator switch to operate said pair of electric motors to make said simulated animal travel faster and slower along said rail.

11. A three-dimensional moving target system as recited in claim 10, wherein said rail is divided into a plurality of sections with snap fasteners between said sections for holding said sections together.

12. A three-dimensional moving target system as recited in claim 10, wherein each said section of said rail includes at least one spike extending downwardly from said bottom wall, so that said spikes can be inserted into the ground to maintain said sections of said rail in a stationary position with respect to the ground.

* * * * *